US007905060B2

(12) United States Patent
Brunner

(10) Patent No.: US 7,905,060 B2
(45) Date of Patent: Mar. 15, 2011

(54) TIERED SEATING SYSTEM

(75) Inventor: William H. Brunner, Grand Rapids, MI (US)

(73) Assignee: Stadium Savers, Ltd., Walker, MI (US)

( * ) Notice: Subject to any disclaimer, the term of this patent is extended or adjusted under 35 U.S.C. 154(b) by 255 days.

(21) Appl. No.: 12/410,107

(22) Filed: Mar. 24, 2009

(65) Prior Publication Data

US 2009/0272042 A1 Nov. 5, 2009

(51) Int. Cl.
*E04H 3/12* (2006.01)

(52) U.S. Cl. ..... 52/8; 52/182; 52/183; 52/188; 52/189; 52/380; 52/582.1; 52/741.2

(58) Field of Classification Search ..... 52/8, 166, 52/182, 183, 379, 380, 384, 385, 582.1, 712, 52/741.2, 747.1, 747.12, 188, 189, 190, 6, 52/7, 9, 10

See application file for complete search history.

(56) References Cited

U.S. PATENT DOCUMENTS 3,305,044 A * 2/1967 Van Loo et al. ..... 181/290
4,226,065 A * 10/1980 Jagemann ..... 52/189
6,634,145 B1 * 10/2003 Dolph ..... 52/189

OTHER PUBLICATIONS

"Proven System for Stadium Risers" brochure published by Stadium Savers, Ltd. (undated but acknowledged as prior art).

* cited by examiner

*Primary Examiner* — Brian E Glessner
*Assistant Examiner* — Patrick Maestri
(74) *Attorney, Agent, or Firm* — Warner Norcross & Judd LLP

(57) ABSTRACT

A tiered seating system includes a series of tiers each including a block pair, a riser, brackets securing the riser to the block pair, and concrete. The block pair includes a lower block and an upper block. The riser is spaced from the front surface of the block pair. The system includes two rows of brackets. The first row is secured between the upper block and the lower block, and is secured to the riser between the bottom and the top of the riser. The second row is secured only to the upper block, and is secured to the top of the riser. The concrete fills the gap between the riser and the blocks and form a layer over the upper block.

20 Claims, 8 Drawing Sheets

TIERED SEATING SYSTEM

BACKGROUND OF THE INVENTION

The present invention relates to tiered seating systems, and more particularly to stadium seating.

Tiered seating systems are widely used in venues to provide each seated person with a generally unobstructed view of a stage, a screen, a performance area, a field, or the like. These venues include auditoriums, theaters, sports arenas, classrooms, and churches. The tiered seating includes rows of seats with each row being higher than the row directly in front of it. Thus, people sitting in the seats have better views than they would if the seats were all on the same level.

One particularly useful type of tiered seating is known as "stadium seating." Such seating is constructed using foam blocks, metal brackets, metal risers, and concrete. The foam blocks are stacked in a desired configuration providing the tiers. The risers are secured to the tiered foam blocks using the brackets with each riser spaced from the front of each tier. The risers provide a concrete form that remains an integral part of the construction after the concrete is cast. The top of each riser is secured to the top of the associated block using the brackets, which are attached to the riser and anchored in the block. Concrete is cast on top of the foam blocks and into the space between the risers and the foam blocks to complete the structure. After the concrete cures, seating is attached to the tiers.

Because the concrete is relatively heavy, it exerts a considerable force on the riser away from the blocks. The gage of the steel riser therefore is preferably sufficiently heavy to prevent the riser from visible bowing or otherwise deforming under the weight of the concrete. Consequently, the riser is relatively heavy and relatively expensive.

SUMMARY OF THE INVENTION

The present invention provides a tiered seating system enabling the riser to be of a lighter gage, so that the riser is lighter and less expensive than in previous systems.

The system includes a unique block and bracket construction to compensate for the lighter gage riser. Each tier includes two blocks—a lower block and an upper block. Brackets are secured between the upper and lower block and are attached to a point approximately midway along the height of the riser. Because the risers are supported both at their top (as in the prior art) and along their height, the brackets collectively provide adequate support to compensate for the reduced thickness of the riser—to prevent visual bowing or other deformation.

The present invention also includes a method of forming a tiered seating system using the described components. The steps of the method include positioning a lower block for each tier, positioning a riser spaced from the lower block, installing a bracket between the riser and the lower block, positioning an upper block, installing a bracket between the upper block and the riser, and casting concrete over the upper block and in the spaced between the riser and the blocks.

Fabricating each tier using a lower and an upper block, using brackets between the two blocks, and connecting those brackets to the riser provides an additional row of brackets supporting the riser approximately midway along its height. In combination with the conventional brackets at the top of the riser, the riser is supported against visible bowing; and the riser maintains its position with respect to the blocks when concrete is poured into the gap between the riser and the blocks. The extra support provided by the additional row of brackets allows the riser to be of reduced gage, which results in weight and cost savings, which more than offsets the weight and the cost of the additional brackets.

These and other objects, advantages, and features of the invention will be more fully understood and appreciated by reference to the description of the current embodiment and the drawings.

DESCRIPTION OF THE CURRENT EMBODIMENT

Figure 1:
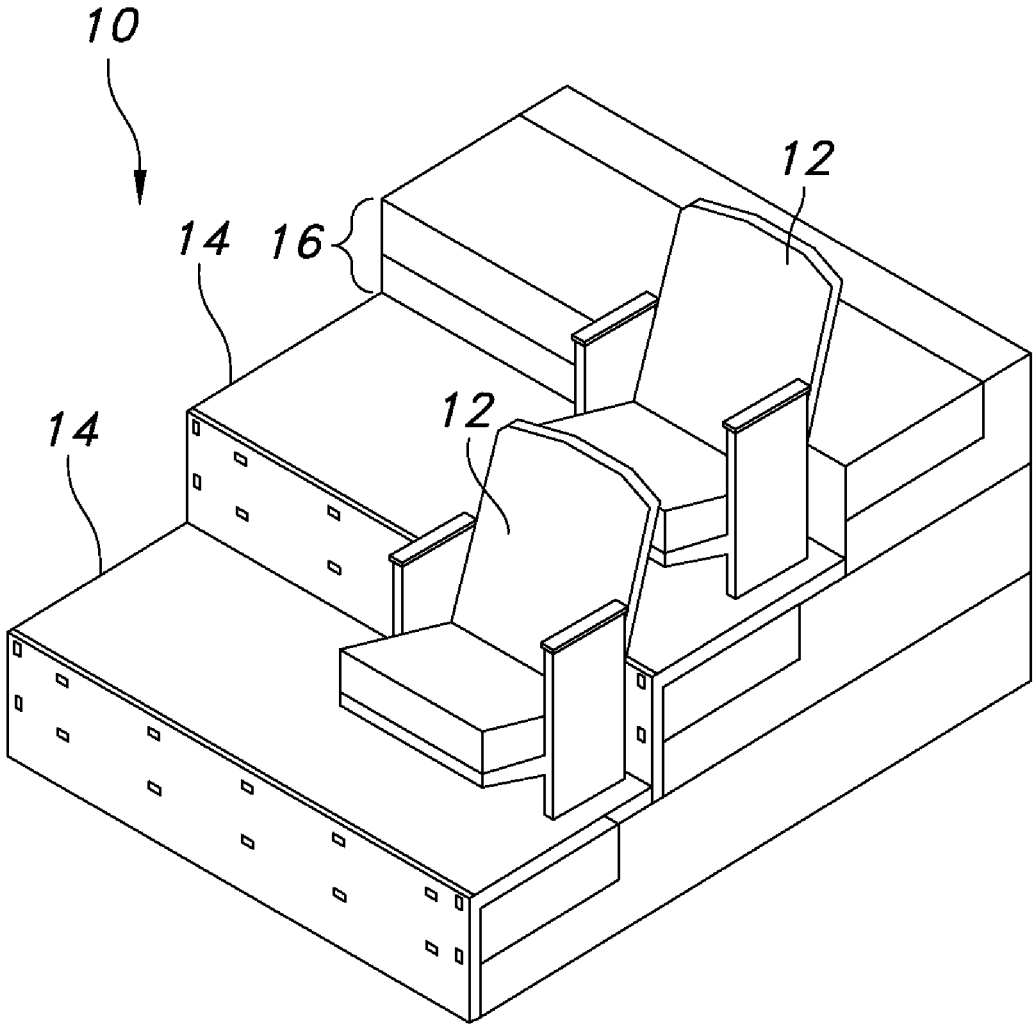
FIG. 1 is a perspective view of a tiered seating system supporting a plurality of seats.
Figure 2:
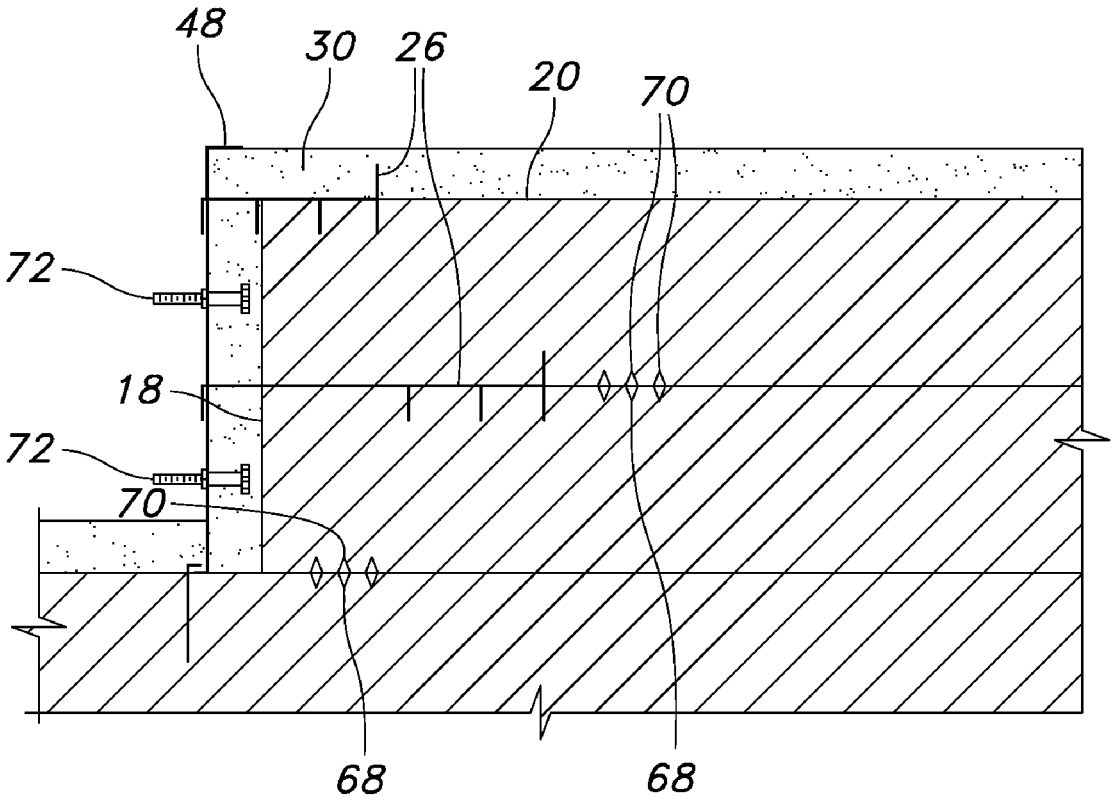
FIG. 2 is a sectional view of a tier in the seating system of FIG. 1.

A tiered seating system in accordance with the present invention is shown in FIG. 1 and is generally designated 10. The seating system 10 includes a plurality of seats 12 supported on a series of tiers 14. As shown in FIG. 2, each of the tiers 14 include a block pair 16, a riser 22, and concrete 30. The block pair 16 includes a lower block 18 and an upper block 20. The riser 22 is spaced from a front surface 24 of the block pair 16 and is secured to both the lower block 18 and upper block 20, respectively, by at least two brackets 26. The brackets 26 maintain a gap 28 between the riser 22 and the block pair 16. The gap 28 is then filled with the concrete 30, which is also applied across an upper surface 32 of the upper block 20, up to the height of the riser 22.

Figure 3:
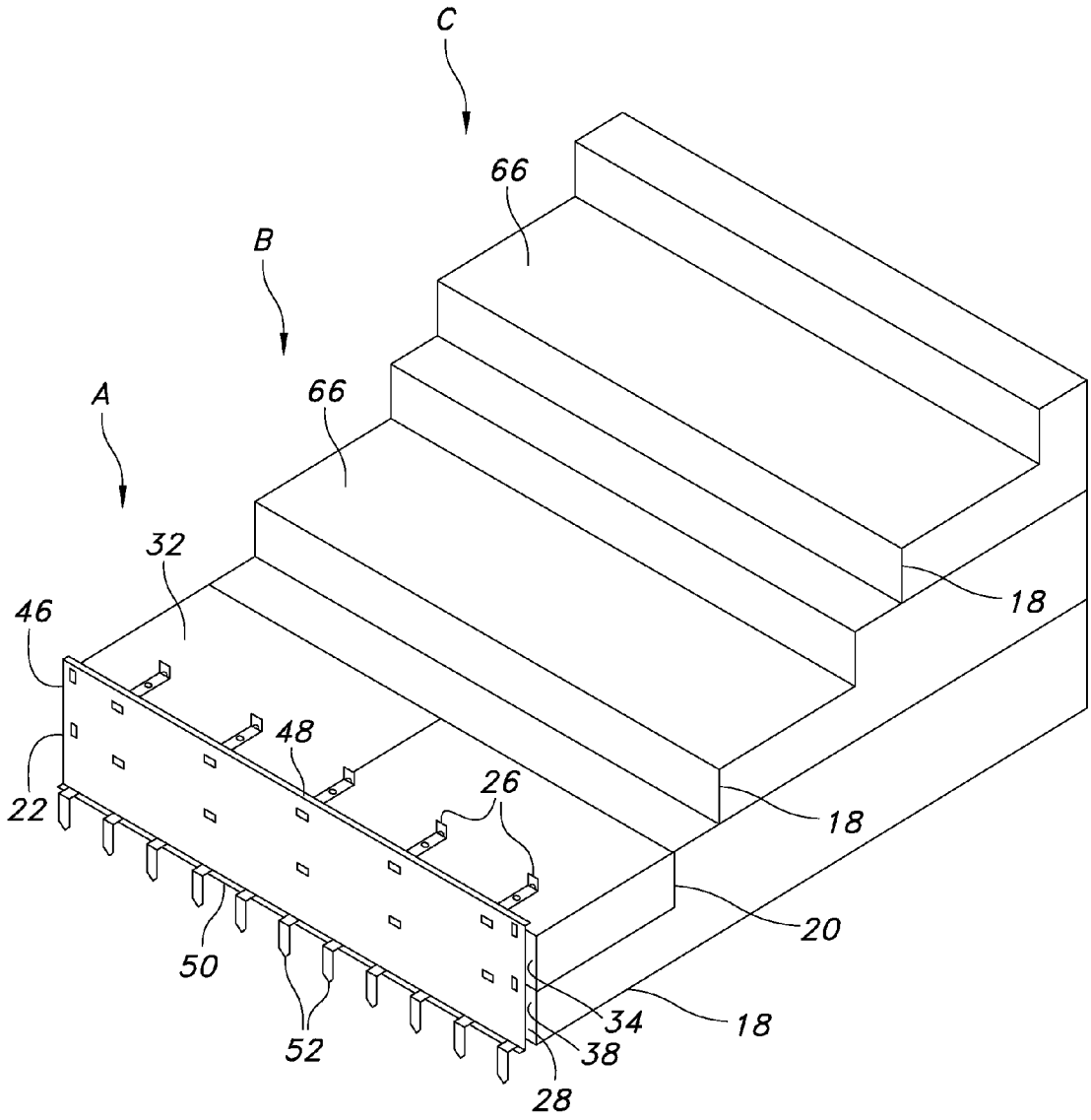
FIG. 3 is a perspective view showing the first or bottom riser secured to the bottom tier.

As shown in FIGS. 3-7, the system 10 includes three partially formed tiers 14, labeled A, B and C. In FIG. 3, the tier A already includes a riser 22 and is ready to receive the material 30, while tiers B and C include only a lower block 18. With reference to tier A, the lower and upper blocks 18 and 20 generally refer to the lower and upper halves, respectively, of the front portion of the block pair 16. In the illustrated embodiment, the lower block 18 is generally L-shaped and forms a recess adapted to receive the upper block 20. The upper block 20 is sized such that the front surface 34 of the upper block 20 is generally flush with the front surface 38 of the lower block 18. Both the lower and upper blocks 18, 20 are formed from blocks of any suitable material, including but not limited to foam, Styrofoam or Geofoam.

Tiers B and C illustrate the typical first step in forming the seating system 10, which is to stack a set of lower blocks 18 on top of one another, with the front end of each block being set back from the front end of the block directly below it. Thus, the lower blocks 18 increase in height, in the manner of a traditional set of tiers or stairs.

In order to maintain the positions of the stacked lower blocks 18, the blocks 18 may be glued together, or gripper plates 68 may be included between the blocks (see FIG. 2). The gripper plate 68 is formed as a generally flat plate having pointed protrusions 70 extending from both sides thereof. The pointed protrusions 70 pierce the upper surface of one lower block 18 and the bottom surface of the other lower block that is stacked on top of it, to prevent the tier portions 18 from sliding with respect to one another. The number of gripper plates 68 appropriate for each lower block 18 will depend in part on the size the tier portions 18 and 20. Optionally, three gripper plates 68 can be used for each lower block 18. One gripper plate 68 can be positioned within approximately six inches of the front edge near the center of the tier portion 18, while the remaining gripper plates 68 can be positioned at the respective sides of the tier portion 18, within approximately six inches of the front and lateral edges of the tier portion 18.

Figure 4:
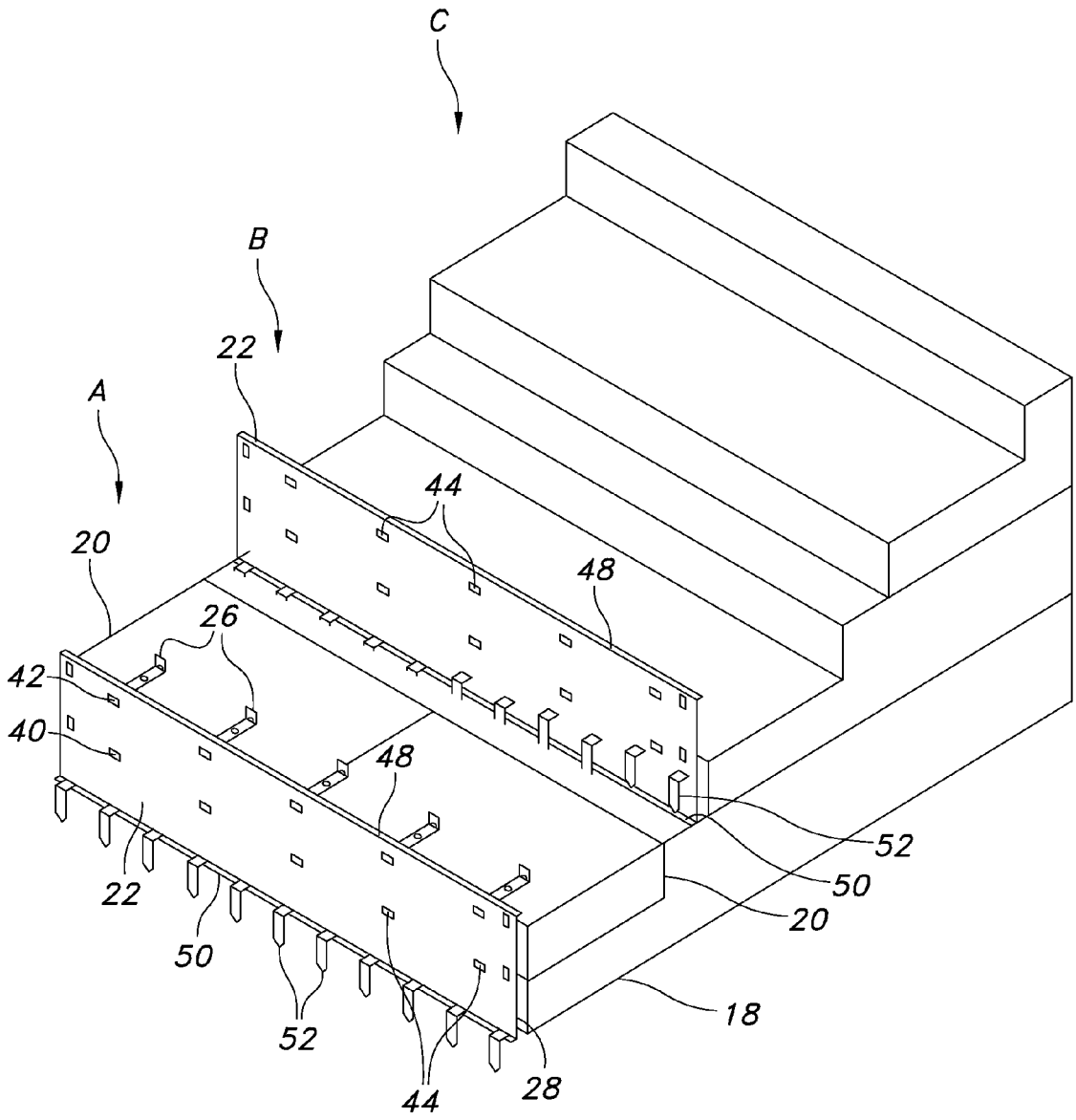
FIG. 4 is a perspective view showing the second riser partially secured to the second tier.

The risers 22 are attached to the block pairs 16. With reference to tier B in FIG. 4, the riser 22 is positioned to be spaced from the front surface 38 of the lower block 18. In the illustrated embodiment, the riser 22 is formed as a thin metal sheet having first and second rows 40, 42 of retaining slots 44 defined therein. The retaining slots 44 are sized and shaped to receive a portion of the bracket 26, which is adapted to maintain the position of the riser 22 with respect to the block pair 16. The retaining slots 44 can be formed in the riser 22 using any known method, including metal stamping. As shown in FIG. 4, the riser 22 can also include at least one retaining slot 44 positioned lengthwise on or near the lateral edges 46 of the riser 22, so that a bracket or any other type of connector can be used to secure adjacent risers 22. Alternatively, the brackets 26 can be attached to the riser 22 using screws or bolts or any other suitable connectors, which may be formed from metal. In the illustrated embodiment, the height of the riser 22 is at least twice the height of the lower block 18, but the present invention is not limited to that ratio.

The riser 22 can include an upper flange or leg 48 and a lower flange or leg 50. For example, the upper and lower legs 48 may be included on the riser 22 in a seating system 10 having straight or upright tiers, as shown in the illustrated embodiment. In a seating system having curved tiers, the upper and lower legs 48 and 50 may not be included. In the illustrated embodiment, the lower leg 50 extends generally perpendicularly from the body of the riser 22 and is adapted to rest on the lower block 18 of the block pair 16 immediately below it. For example, with reference to tier B in FIG. 4, the lower leg 50 of the riser 22 rests on the lower block 18 of tier A. To maintain the position of the lower leg 50, at least one stake 52 is pressed into the lower block 18 of tier A near the lower leg 50. The stake 52 can include a pointed end 54 adapted to puncture the lower block 18 and a retaining end 56 adapted to engage and rest on the lower leg 50 of the riser 22 (see FIG. 4).

Figure 8:
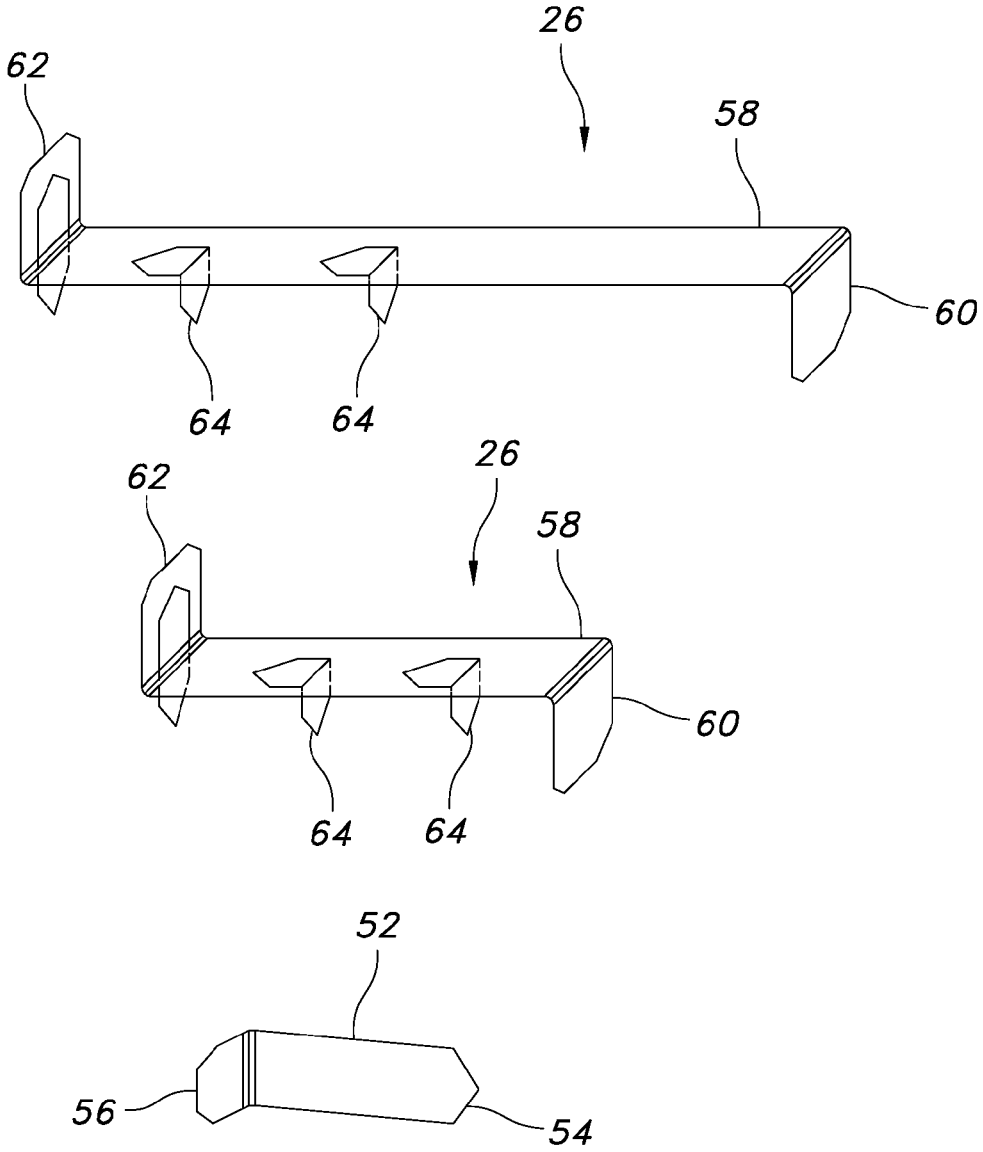
FIG. 8 is a perspective view of the brackets and the stake used to secure the riser to the upper and lower blocks.

The middle brackets 26 are then secured to the riser 22 to maintain the position of the riser 22 with respect to the lower block 18 of tier B. The brackets 26 can be formed in any suitable size and shape to secure the riser 22 to the lower and upper blocks 18 and 20. Alternatively, any suitable connector or retainer can be used in place of the brackets 26. As shown in FIG. 8, the brackets 26 each include a generally flat middle portion 58 and first and second flanges 60 and 62, which extend generally perpendicular from the middle portion 58. In the illustrated embodiment, the first and second flanges 60, 62 extend in opposite directions from the middle portion 58. Optionally, the bracket 26 can also include at least one tab 64 extending from the middle portion 58. The tabs 64 are pointed and adapted to pierce the surface of the lower and upper blocks 18, 20. In the illustrated embodiment, two of the tabs 64 are punched or pressed out of the middle portion 58 of the bracket 26, while a third tab 64 is punched or pressed out of the second flange 62.

Figure 5:
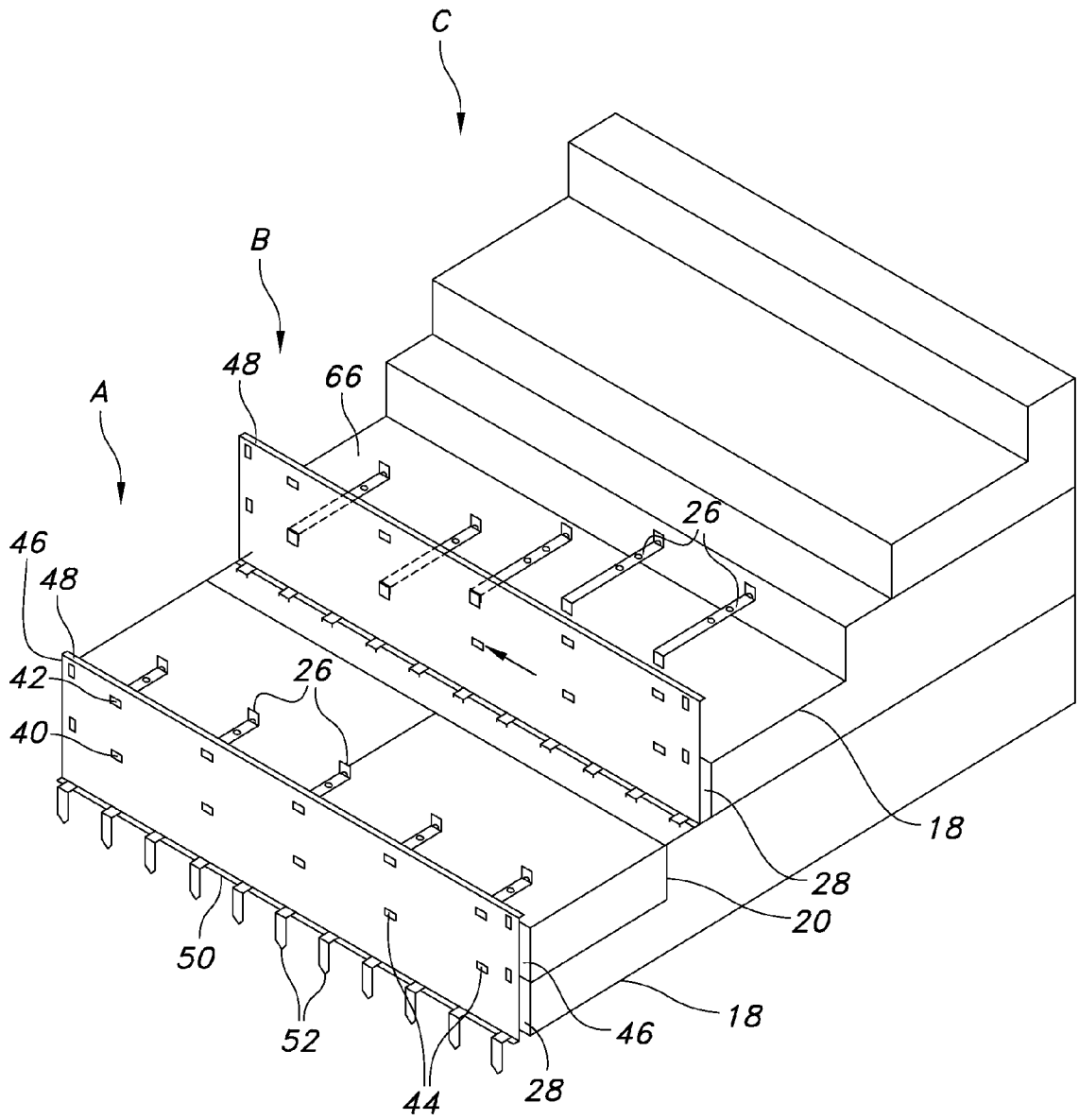
FIG. 5 is a perspective view showing the second riser further partially secured to the second tier with a middle row of brackets partially installed.

As shown in FIG. 5, the first flange 60 is inserted through one of the retaining slots 44 in row 40 in the riser 22. The row 40 is located near the center of the riser 22. The bracket 26 is oriented such that the first flange 60 and the tabs 64 are pointing generally downward. The middle portion 58 of the bracket 26 can then be pressed onto the upper surface 66 of the lower block 18, such that the tabs 64 pierce the upper surface 66 to secure the bracket 26 to the lower block 18. In this configuration, the tabs 64 and the first flange 60 maintain the position of the riser 22 with respect to the lower block 18. Specifically, the tabs 64 function to resist movement of the riser 22 and bracket 26 away from the lower block 18. As shown in FIG. 5, in this orientation, the second flange 62 points generally upward and perpendicular to the upper surface 66 of the lower block 18. The number of brackets 26 appropriate to secure the riser 22 to the lower block 18 will depend in part on the size and the length of both the riser 22 and the lower block 18.

Figure 6:
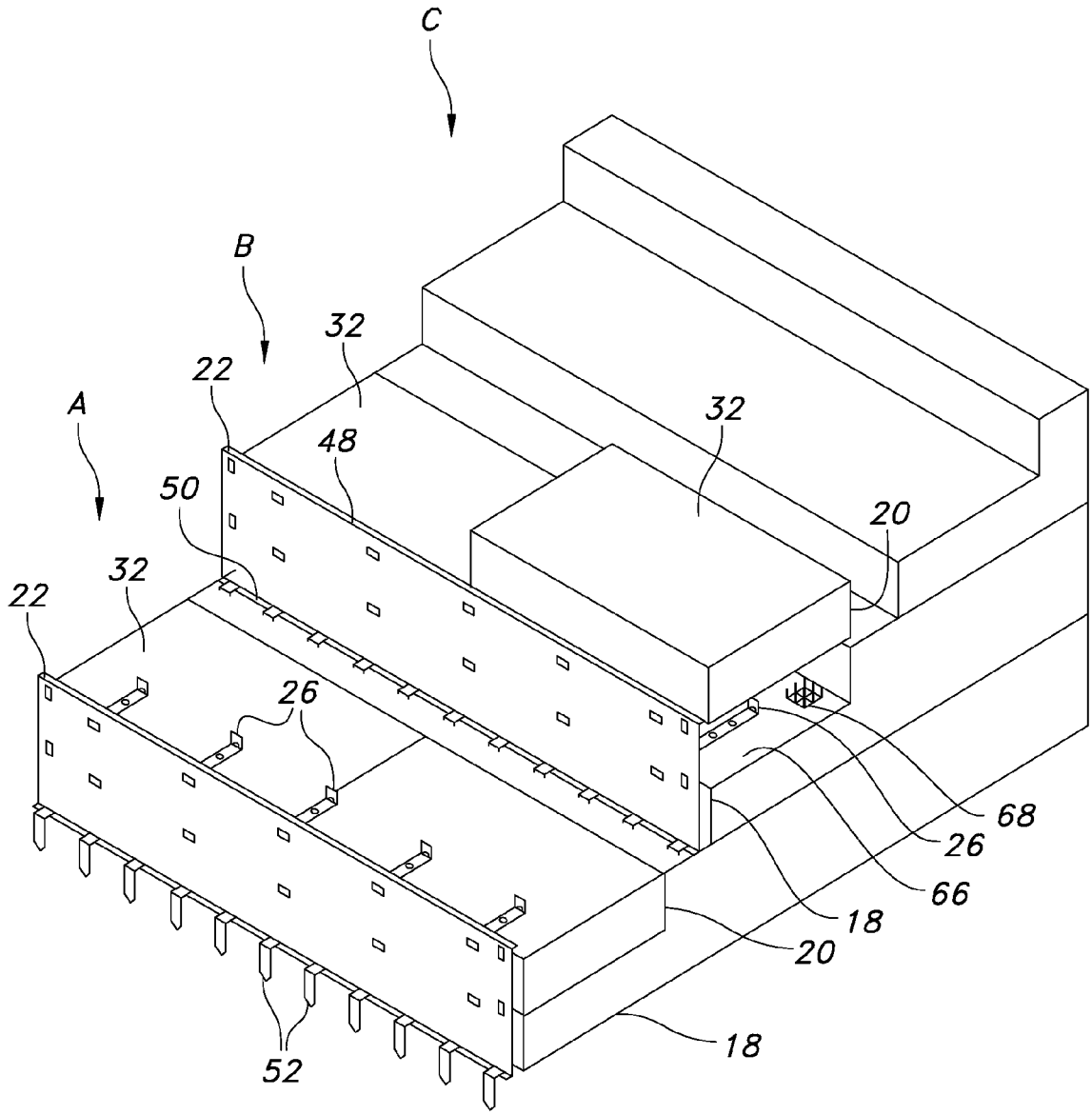
FIG. 6 is a perspective view showing an upper block being placed on the lower block of the second tier.

The upper block 20 can then be placed on top of the lower block 18, in the recess created by the L-shaped lower block 18 (see FIG. 6). The bottom surface of the upper block 20 is pressed onto and over the second flanges 62 of the brackets 26 that secure the lower block 18 to the riser 22. Thus, the first series of brackets 26 maintains the position of both the riser 22 and the upper block 20 with respect to the lower block 18. In the illustrated embodiment, two upper blocks 20 cover the single lower block 18 in each of tiers A, B and C.

To assist in maintaining the position of the upper block 20 with respect to the lower block 18, at least one gripper plate 68 is included on an upper surface 66 of the lower block 18. The gripper plate 68 is substantially similar or identical to the gripper plate 68 used to maintain the stacked position of the lower blocks 18, as described above, and includes pointed protrusions 70, which pierce both the upper surface 66 of the lower block 18 and the bottom surface of the upper block 20 to maintain the relative positions of the upper and lower blocks 18, 20. The number of gripper plates 68 appropriate to stabilize the lower and upper blocks 18 and 20 will depend in part on the size the tier portions 18 and 20.

Figure 7:
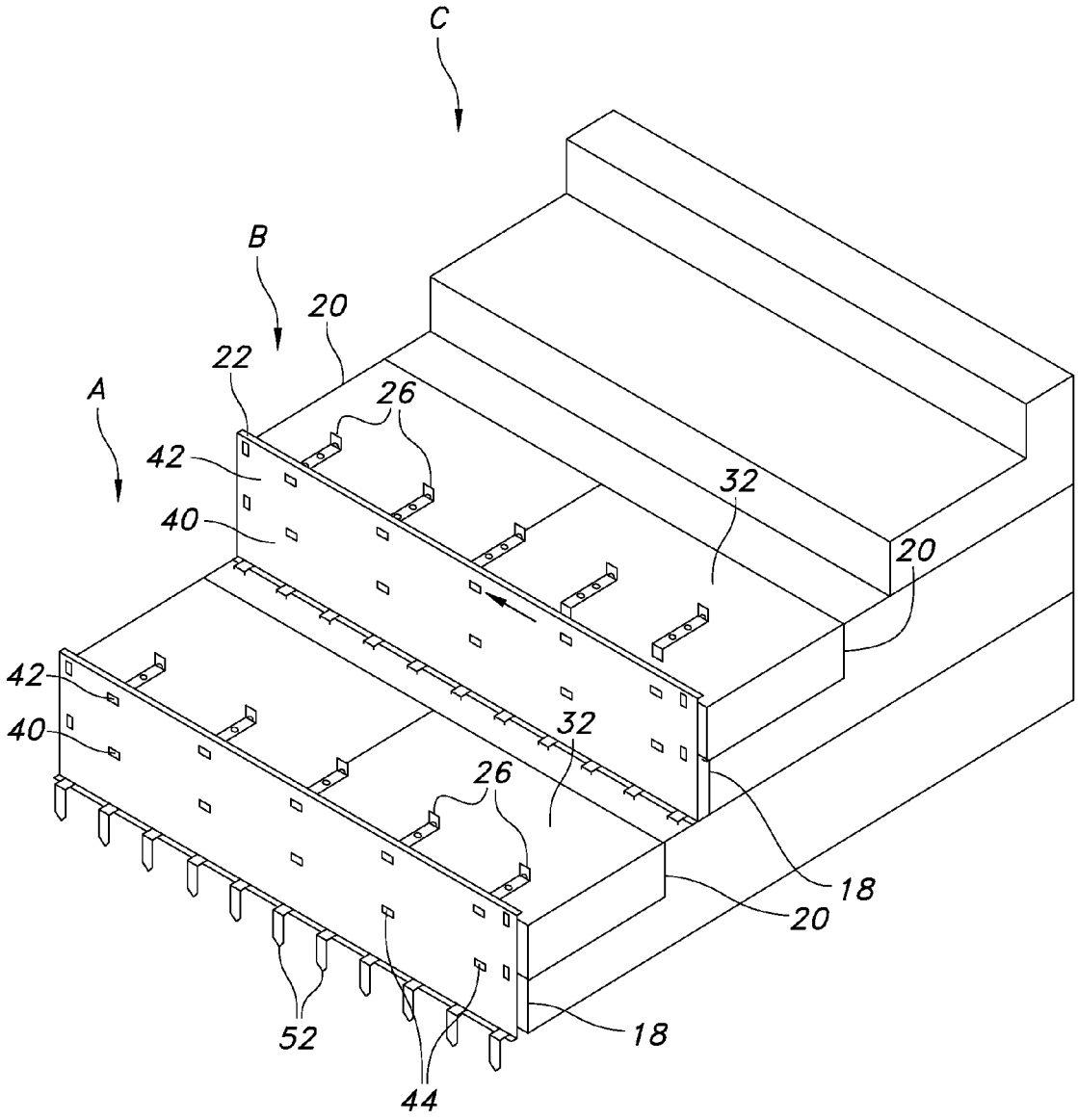
FIG. 7 is a perspective showing the installation of an upper row of brackets on the upper block of the second tier.

Once in place on top of the lower block 18, the upper brackets 26 are installed to secure the riser 22 to the upper blocks 20. The brackets 26 are substantially similar or even identical to the brackets 26 used to secure the riser to the lower block 18, but may have a shorter length, as shown in FIG. 2. The brackets 26 are applied in generally the same manner as described above with respect to the lower block 18. For example, as shown in FIG. 7, a series of brackets 26 are inserted into the retaining slots 44 in row 42 on the riser 22. The row 42 is located along a second line along an upper portion of the riser 22. The first flange 60 of the bracket 26 is inserted through the retaining slot 44, with the first flange 60 and the tabs 64 pointing generally downward. The middle portion 58 of the bracket 26 is then pressed onto the upper surface 32 of the upper block 20, so that at least one of the tabs 64 pierces the upper surface 32. Thus, the tabs 64 secure the bracket 26 to the upper block 20 and function to resist movement of the riser 22 and bracket 26 away from the upper block 20. The second flange 62 extends generally upward from and perpendicular to the top surface 32 of the upper block 20, and can act as an anchor for the material 30 that will be poured over the block pair 16.

Thus, the stakes 52, brackets 26 and gripper plates 68 securely maintain the position of the riser 22 and the lower and upper blocks 18, 20. Optionally, to assist in supporting the seats 12 after the concrete 30 is poured, bolt assemblies 72 can be secured to the riser 22 (see FIG. 2). Securing the bolt assemblies 72 prior to the pouring of the material 30 can allow the concrete 30 to harden about the bolt assemblies 72 to provide a more secure and permanent connection, such that the bolt assemblies can better support the seating.

As shown in FIG. 7, the tiers A and B (once the brackets 26 have been fully inserted into the retaining slots 44 in row 42) are ready to receive the concrete 30, which fills the gap 28 between the block pair 16 and the riser 22. The concrete 30 also is poured to form a layer on the top surface 32 of the upper block 20. In the current embodiment, concrete 30 is the preferred casting material. Other suitable materials can also be used. Because of its weight, the uncured concrete exerts a force against the riser 22 in a direction away from the block pair 16. However, the brackets 26 assist the riser 22 in resisting this force to maintain the generally vertical position of the riser 22 with respect to the block pair 16 and to prevent bowing or other deformation. As shown in FIG. 2, the concrete 30 is poured to a level that is even with the upper leg 48 of the riser 22. Optionally, side forms (not shown) can be used to contain the material 30 laterally to the desired areas in the respective tiers A and B. Once the concrete 30 hardens, the tiers 14 are capable of supporting seats, bleachers or the like.

The method described above, primarily with respect to tier B, can be repeated with tier C, and any additional number of tiers, as desired.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A tiered seating system comprising:

a plurality of block pairs arranged in a tiered configuration, each block pair including a lower block and an upper block and having a front surface;

a plurality of risers each spaced from the front surface of one of the block pairs;

a plurality of middle brackets each secured between the upper block and the lower block of a block pair, and each secured to the associated riser;

a plurality of top brackets each secured to the upper block, and each secured to the associated riser, the brackets collectively spacing the risers and the block pairs; and a material filling the spaces between the risers and block pairs.

2. The seating system of claim 1 wherein:

each of the risers includes a plurality of retaining slots; and each of the brackets includes a first flange extending into one of the retaining slots.

3. The seating system of claim 2 wherein each middle bracket includes at least one tab extending into at least one of the lower and upper blocks.

4. The seating system of claim 3 wherein:

the riser includes a top portion, a bottom portion, and central portion between the top and bottom portions; and some of the slots being arranged in a middle row across a central portion of the riser, the retaining slots in the middle row each being adapted to receive the first flange of one of the brackets to secure the riser to the lower block.

5. The seating system of claim 4 wherein others of the slots are arranged into an upper row across the top portion of the riser, the retaining slots in the upper row each being adapted to receive the first flange of one of the brackets to secure the riser to the upper block.

6. The seating system of claim 5 wherein each of the brackets includes a second flange extending generally upward.

7. The seating system of claim 6 wherein:

the upper block includes a bottom surface and an upper surface; and the second flange extends into the bottom surface of the upper block.

8. The seating system of claim 1 including at least one of glue and at least one gripper plate between the lower and upper blocks, wherein the gripper plate includes a plurality of pointed protrusions extending into a top surface of the lower block and a bottom surface of the upper block.

9. The seating system of claim 4 including at least one stake securing a riser to a block.

10. The seating system of claim 1 wherein the riser is generally parallel with the front surface of the tier.

11. The seating system of claim 1 wherein the material is concrete.

12. The seating system of claim 1 wherein the lower and upper blocks comprise a foam material.

13. A method of forming a tiered seating system comprising:

arranging a plurality of blocks into a series of tiers, each tier having a lower block;

positioning a riser in a spaced relationship from the front surface of each of the lower blocks;

installing a first connector connected both to each riser and to the associated lower block;

placing an upper block on each lower block;

installing a second connector connected both to each riser and to the associated upper block; and pouring a structural material into the space between the riser and the blocks.

14. The method of claim 13 wherein the first installing step includes connecting the first connector to both of the lower block and the upper block.

15. The method of claim 13 wherein the first installing step includes inserting a flange of the connector into a slot in the riser.

16. The method of claim 13 wherein the first installing step includes inserting a tab extending from the connector into the lower block.

17. The method of claim 14 wherein the first installing step includes trapping the first connector between the lower block and the upper block.

18. The method of claim 13 further comprising installing a plurality of stakes each securing a lower portion of the associated riser and extending into one of the blocks.

19. The method of claim 13 wherein the placing step includes inserting at least one gripper plate between the lower block and the upper block to prevent the block from sliding relative one another.

20. The method of claim 13 wherein the pouring step includes pouring concrete.

* * * * *